US008646646B2

(12) United States Patent
Yourist

(10) Patent No.: US 8,646,646 B2
(45) Date of Patent: Feb. 11, 2014

(54) REINFORCED RETORTABLE PLASTIC CONTAINERS

(75) Inventor: Sheldon E. Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 13/468,755

(22) Filed: May 10, 2012

(65) Prior Publication Data

US 2012/0312826 A1 Dec. 13, 2012

Related U.S. Application Data

(63) Continuation-in-part of application No. 12/941,334, filed on Nov. 8, 2010, now Pat. No. 8,281,953, which is a continuation-in-part of application No. 12/727,932, filed on Mar. 19, 2010, now Pat. No. 8,365,945.

(51) Int. Cl.
*B65D 90/02* (2006.01)

(52) U.S. Cl.
USPC ..... 220/672; 220/669

(58) Field of Classification Search
USPC ..... 220/604, 669, 672, 674, 675, 906; 215/382, 383
See application file for complete search history.

(56) References Cited

U.S. PATENT DOCUMENTS

| | | | |
|---|---|---|---|
| D67,464 | S | 6/1925 | Johnson |
| D200,443 | S | 2/1965 | Deegan |
| D201,400 | S | 6/1965 | Kneeland |
| D205,686 | S | 9/1966 | Marchant |
| 3,357,593 | A | 12/1967 | Sears, Jr. et al. |
| 3,685,685 | A | 8/1972 | Philips |
| D232,080 | S | 7/1974 | Strand |
| 4,102,467 | A | 7/1978 | Woodley |
| D277,041 | S | 1/1985 | Nichols |
| 4,840,289 | A | 6/1989 | Fait et al. |
| 4,880,129 | A | 11/1989 | McHenry et al. |
| 4,890,759 | A | 1/1990 | Scanga |
| 4,948,006 | A | 8/1990 | Okabe et al. |
| 4,997,691 | A | 3/1991 | Parkinson |

(Continued)

FOREIGN PATENT DOCUMENTS

| | | | |
|---|---|---|---|
| GB | 2161133 | A | 1/1986 |
| WO | 02074635 | A1 | 9/2002 |

OTHER PUBLICATIONS

Gilpin and Company, Inc. Plastic Packaging. Retrieved from www.gilpinezo.com/offers.html.

(Continued)

*Primary Examiner* — Anthony Stashick
*Assistant Examiner* — Kevin Castillo
(74) *Attorney, Agent, or Firm* — Baker Botts L.L.P.

(57) ABSTRACT

A reinforced retortable plastic container includes a bottom portion and a main body portion having a plastic sidewall that is connected to the bottom portion. The main body portion has a reinforced sidewall area that includes a plurality of first sidewall portions and a plurality of second sidewall portions that are respectively interposed between the first sidewall portions. Each of the second sidewall portions is shaped to define a plurality of circumferentially spaced structures that are selected from the group consisting of indentations and projections. Each of the circumferentially spaced structures is interposed between adjacent vertical columns, and adjacent second sidewall portions are rotationally staggered with respect to each other so that the vertical columns on one second sidewall portion are not aligned with the vertical columns of an adjacent second sidewall portion.

19 Claims, 12 Drawing Sheets

(56) References Cited

U.S. PATENT DOCUMENTS

| | | | |
|---|---|---|---|
| 5,054,632 | A | 10/1991 | Alberghini et al. |
| 5,071,029 | A | 12/1991 | Umiah et al. |
| D323,290 | S | 1/1992 | Keedy |
| D324,493 | S | 3/1992 | Nickerson |
| 5,217,737 | A | 6/1993 | Gygax et al. |
| 5,234,126 | A | 8/1993 | Jonas et al. |
| D354,200 | S | 1/1995 | Grappolini |
| 5,718,352 | A | 2/1998 | Diekhoff et al. |
| 5,746,339 | A | 5/1998 | Petre et al. |
| 6,095,360 | A | 8/2000 | Shmagin et al. |
| D454,190 | S | 3/2002 | Trocola |
| D469,351 | S | 1/2003 | Huang |
| 6,520,362 | B2 | 2/2003 | Heisel et al. |
| D482,571 | S | 11/2003 | Leinenweber |
| D485,182 | S | 1/2004 | Gaydon |
| D515,927 | S | 2/2006 | Smay et al. |
| D523,347 | S | 6/2006 | Livingston |
| 7,055,713 | B2 | 6/2006 | Rea et al. |
| 7,178,687 | B1 | 2/2007 | Manderfield, Jr. et al. |
| D545,684 | S | 7/2007 | DeMaso et al. |
| D547,667 | S | 7/2007 | DeMaso et al. |
| D551,026 | S | 9/2007 | Morgan et al. |
| D559,120 | S | 1/2008 | Farrow et al. |
| D559,121 | S | 1/2008 | Farrow et al. |
| D608,203 | S | 1/2010 | Yourist |
| D625,202 | S | 10/2010 | Yourist |
| D632,590 | S | 2/2011 | Peacock |
| D634,635 | S | 3/2011 | Araujo et al. |
| D653,543 | S | 2/2012 | Yourist et al. |
| D653,544 | S | 2/2012 | Yourist et al. |
| D653,545 | S | 2/2012 | Yourist et al. |
| 2004/0149677 | A1 | 8/2004 | Slatt et al. |
| 2004/0211746 | A1 | 10/2004 | Trude et al. |
| 2009/0166314 | A1 | 7/2009 | Matsuoka |
| 2011/0226787 | A1 | 9/2011 | Yourist |
| 2011/0226788 | A1 | 9/2011 | Yourist |

OTHER PUBLICATIONS

International Search Report for International Application No. PCT/US2011/029014 dated Aug. 22, 2011.

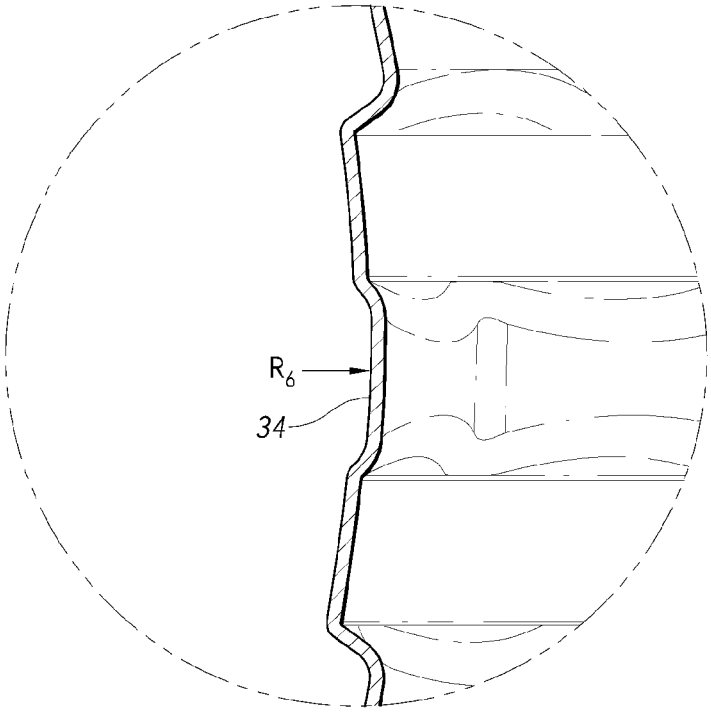
FIG. 5
FIG. 6
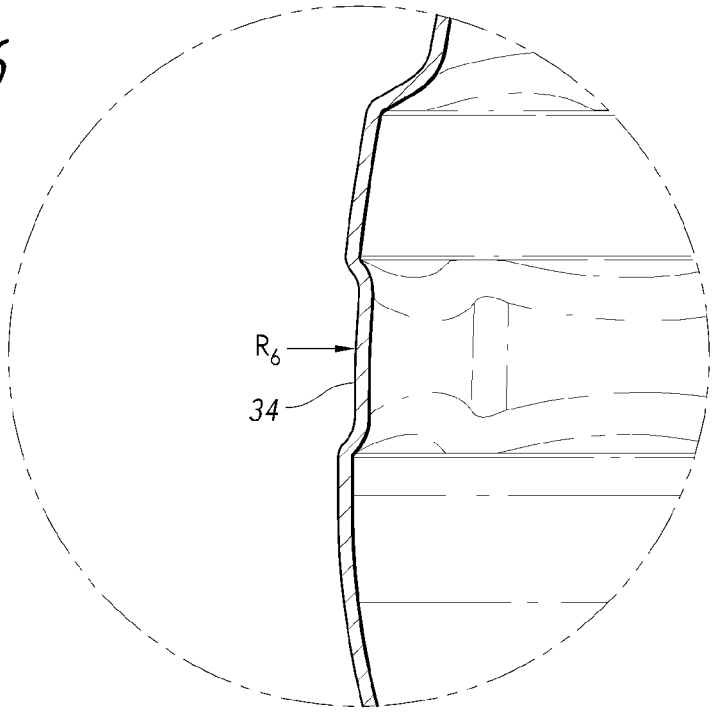

REINFORCED RETORTABLE PLASTIC CONTAINERS

This is a continuation-in-part of application Ser. No. 12/941,334, filed Nov. 8, 2010, which is a continuation-in-part of application Ser. No. 12/727,932, filed Mar. 19, 2010. Priority under 35 U.S.C. §120 is claimed to both of the aforementioned applications, and the entire disclosure thereof is hereby incorporated by reference as if set forth fully herein.

BACKGROUND OF THE INVENTION

1. Field of the Invention

This invention relates generally to the field of packaging, and more specifically to the field of retortable plastic containers. More specifically, the invention relates to an improved retortable container that is more dimensionally stable during the sterilization process than conventional predecessor containers.

2. Description of the Related Technology

Certain products require sterilization during the packaging process in order to inhibit the growth of bacteria. Products requiring sterilization include foods such as milk, yogurt and various sauces, as well as certain pharmaceutical products. Thermal processing, sterilization, canning and retorting are all terms referring to the process of taking a food product, already sealed in its container, and heating it to a specific temperature for a specific time. The objective is to kill spoilage organisms and pathogenic bacteria, thus preserving the food and allowing it to be stored unrefrigerated for extended lengths of time.

There are multiple designs for retorting food containers, including batch systems and continuous systems. In a batch system, containers are placed in crates or baskets, which are then loaded into a vessel into which the heating medium is introduced. This method is the oldest and most traditional and also the most versatile in the range of products and container sizes it can handle. In a continuous retort system, a conveyor is used to continuously transport the containers to be sterilized through a heating chamber that contains the heating medium. There are advantages to each method depending on individual processing operations and, just as important, the type of food being processed.

Traditionally, products that require heat sterilization have been packaged in glass containers, which are relatively stable at elevated temperatures and pressures. However, in recent years plastic retortable containers have come into use. Plastic containers tend to be less expensive than glass containers and safer in many respects because they will not shatter when dropped. Unfortunately, plastic containers may lack the column strength that is necessary to avoid deformation of the sidewall of the container when a number of containers or palettes of containers are stacked during transportation or in packaging or retail facilities. While it is possible to increase the strength of a plastic container by increasing the thickness of the sidewall, doing so also increases manufacturing costs by increasing the amount of plastic material that is required. Lightweighting is an important consideration in the design of plastic containers, including plastic cans, because plastic material tends to be relatively expensive.

Many plastic containers also lack the requisite circumferential or hoop strength that is required to avoid excessive deformation when the contents of the container becomes pressurized, such as during a heat sterilization process.

The most common commercial procedure for heat sterilizing canned foods is a retort process in which filled but unsterilized sealed cans are placed in a retort chamber that is injected with steam and held at a predetermined elevated temperature (typically between about 210° F. to about 260° F.) for a predetermined period of time. Conventional plastic containers have been considered unsuitable for packaging applications in which heat sterilization is required, because the heat and pressurization that is inherent to such processes has the tendency to cause irreversible damage and deformation to the sidewall of the plastic can.

The temperatures of the retort process are elevated enough to temporarily increase the internal pressurization of the container. Plastic retortable containers accordingly have been designed to permit limited and reversible controlled flexure of one or more surfaces in order to accommodate the internal volumetric changes that are inherent to the retort sterilization process. U.S. Pat. No. 5,217,737 to Gygax et al. discloses a retortable plastic container that has a flexible bottom portion to accommodate internal volumetric changes. Other retortable containers that have been in commercial use have a champagne style bottom portion that is designed to permit a certain amount of flexure. However, when using a continuous retort process the flexure of retortable plastic containers must be limited so that it will not interfere with the process of conveying the container through the continuous retort system. Typically, such conveyors require at least two dimensionally stable points of contact on the container.

A need accordingly exists for an improved retortable container that exhibits improved dimensional stability and strength during the retort process without significantly adding to material costs.

SUMMARY OF THE INVENTION

Accordingly, it is an object of the invention to provide an improved retortable container that exhibits improved dimensional stability and strength during the retort process without significantly adding a material costs.

It is further an object of the invention to provide a plastic container that has sufficient column strength and hoop strength to replace a glass or metal container, and that has sufficient rigidity and stability under elevated pressures and temperatures to permit heat sterilization without experiencing excessive deformation.

In order to achieve the above and other objects of the invention, a plastic container according to a first aspect of the invention includes a bottom portion and a main body portion connected to the bottom portion. The main body portion has a plastic sidewall fabricated from a plastic material that is suitable for heat sterilization applications. The sidewall includes a plurality of circumferentially extending first sidewall portions and a plurality of circumferentially extending second sidewall portions, each of the second sidewall portions being interposed between two adjacent first sidewall portions. Each of the second sidewall portions includes a plurality of circumferentially spaced vertical columns, and wherein adjacent second sidewall portions are rotationally staggered with respect to each other so that the vertical columns on one second sidewall portion are not aligned with the vertical columns of an adjacent second sidewall portion.

A reinforced retortable plastic container according to a second aspect of the invention includes a bottom portion and a main body portion. The main body portion has a plastic sidewall fabricated from a plastic material that is suitable for heat sterilization applications and is connected to the bottom portion. The main body portion has a reinforced sidewall area that includes a plurality of first sidewall portions and a plurality of second sidewall portions that are respectively interposed between the first sidewall portions. Each of the second sidewall portions is shaped to define a plurality of circumferentially spaced structures that are selected from the group consisting of indentations and projections.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 5 is a cross-sectional view taken along lines 5-5 in FIG. 1;

FIG. 6 is a cross-sectional view taken along lines 6-6 in FIG. 1;

DETAILED DESCRIPTION OF THE PREFERRED EMBODIMENT(S)

Figure 1:
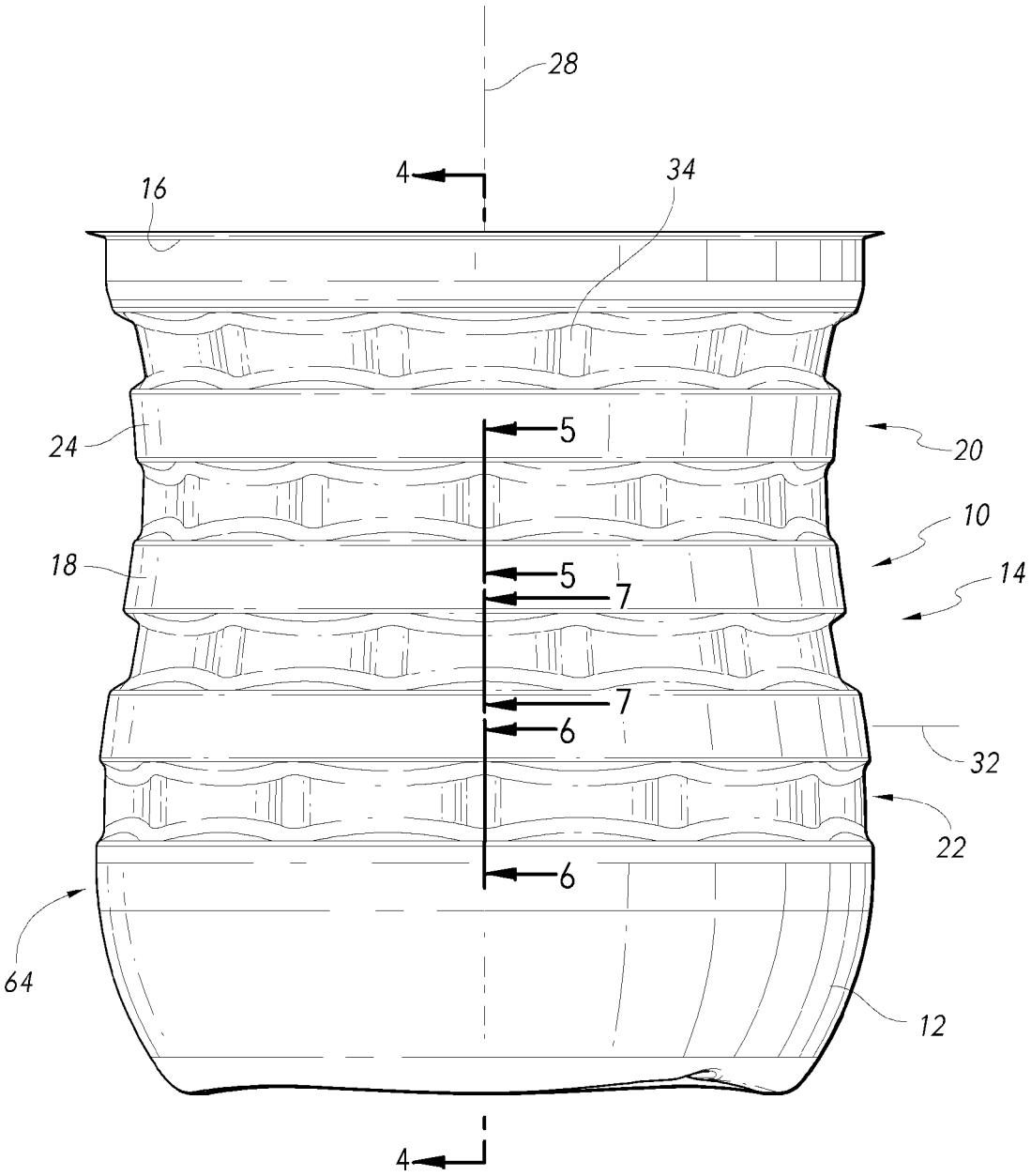
FIG. 1 is a front elevational view of a retortable plastic container that is constructed according to a preferred embodiment of the invention.

Referring now to the drawings, wherein like reference numerals designate corresponding structure throughout the views, and referring in particular to FIG. 1, a retortable plastic container 10 that is constructed according to a preferred embodiment of the invention is preferably fabricated from a food grade plastic material such as polyolefin, polypropylene, polyethylene or high-density polyethylene using a conventional extrusion blow molding process. The most preferred construction of the plastic portion of the retortable plastic container 10 is discussed in greater detail below.

Alternatively, retortable plastic container 10 may be fabricated from a material such as polyethylene terephthalate (PET) using a conventional reheat stretch blow molding process.

As is best shown in FIG. 1, retortable plastic container 10 preferably includes a bottom portion 12 and a main body portion 14 having a plastic sidewall 18 that is connected to the bottom portion 12. The main body portion 14 preferably defines an upper rim 16 forming a mounting portion 17 that is adapted to be secured to a lid member 30, as is diagrammatically shown in FIGS. 9 and 10.

The lid member 30 is preferably fabricated from a metallic material such as steel, but it alternatively could be fabricated from a plastic material or any other suitable material. The lid member 30 is preferably secured to the upper rim 16 using a standard double seaming process of the type that is used to seal metal cans. Alternatively, the lid member 30 could be welded or otherwise secured to the upper rim 16. In another embodiment, a neck finish and closure could be provided in lieu of the flange and lid member.

In the preferred embodiment, the bottom portion 12 is integral with the plastic sidewall 18 and is also fabricated from a plastic material. Alternatively, the retortable plastic container 10 could be made for a three-piece construction, in which the container 10 is constructed as an open tube having a bottom rim that is similar to the upper rim 16, and a bottom lid could be secured in the manner described above with reference to the lid member 30.

Figure 2:
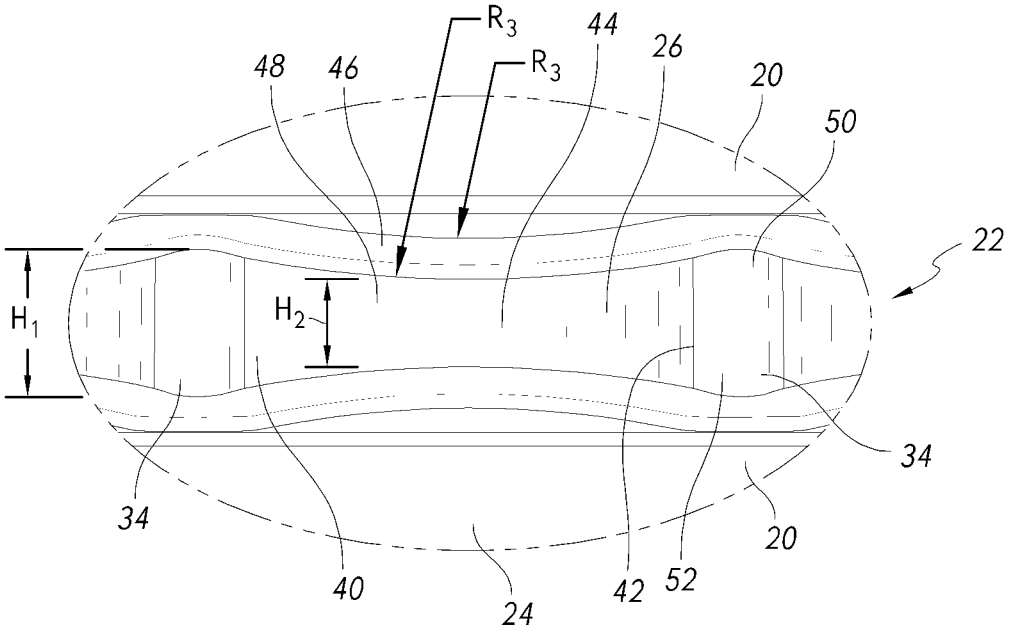
FIG. 2 is an isolation view of a portion of the retortable plastic container that is shown in FIG. 1.
Figure 3:
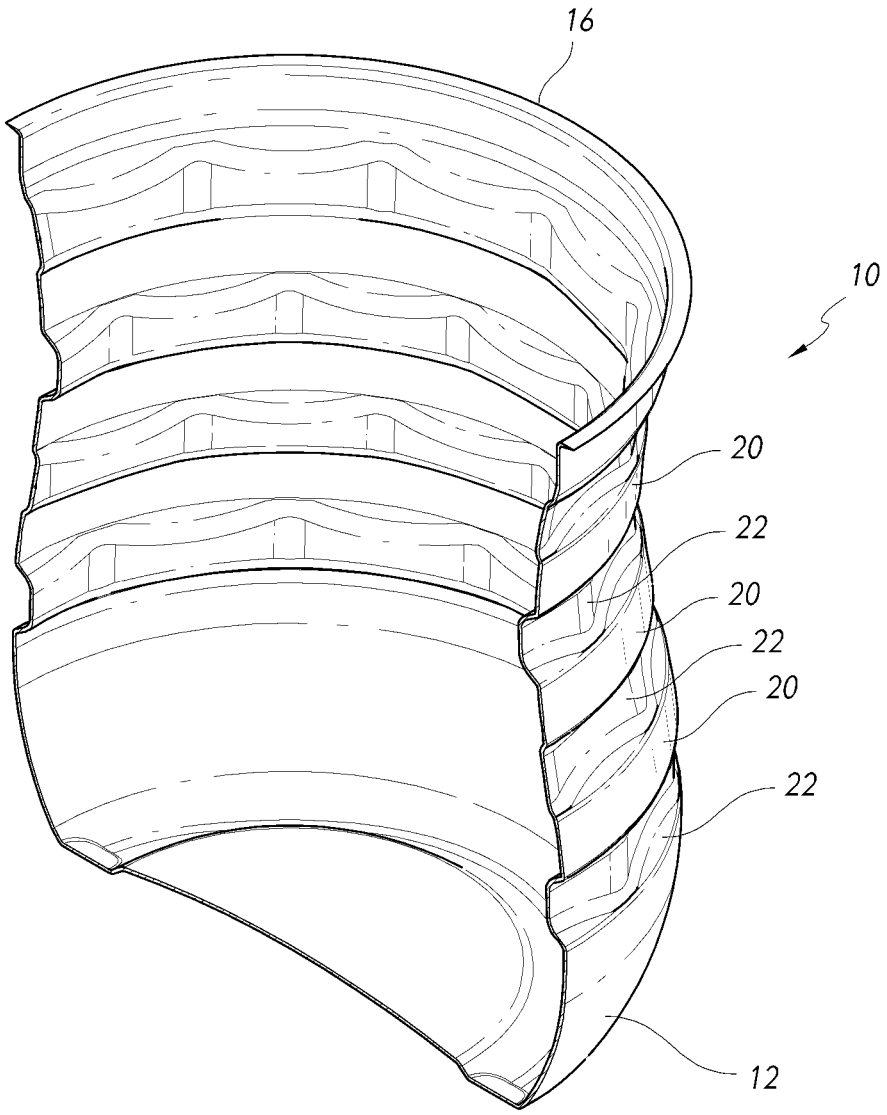
FIG. 3 is a fragmentary perspective view of the retortable plastic container that is shown in FIG. 1.

As is best shown in FIGS. 1 and 2, the sidewall 18 is preferably constructed to define a plurality of first sidewall portions 20 and a plurality of second sidewall portions 22, each of which is interposed between two adjacent first sidewall portions 20. The first sidewall portions 20 are each preferably constructed so that they have substantially flat circumferentially extending outer surface 24, which in the preferred embodiment extends about an entire circumference of the main body portion 14.

The substantially flat circumferentially extending outer surfaces 24 are preferably oriented so as to conform with vertical sections of a generally hourglass shaped profile of the container 10 as viewed in side elevation, as shown in FIG. 1. Each surface is preferably substantially planar and resides within a plane that is parallel or slightly angled with respect to a longitudinal axis 28 of the main body portion 14.

Alternatively, the outer circumferential surface of the first sidewall portions 20 could be convexly or concavely curved, or it could have a more complex shape.

In addition, each of the substantially flat circumferentially extending outer surfaces 24 preferably intersect and are generally parallel to a horizontal plane 32 that is perpendicular to the longitudinal axis 28 of the main body portion 14, as is shown diagrammatically in FIG. 1.

The main body portion 14 is preferably substantially hourglass shaped, but it could alternatively be constructed of any one of a plurality of possible alternative shapes, including a tapered shape or a complex shape according to the preferences of a packaging customer. Preferably, but not necessarily, the main body portion is shaped so that it is substantially symmetrical about the longitudinal axis 28.

Each of the second sidewall portions 22 is preferably shaped to define a plurality of circumferentially spaced indentations 26. Each of the second sidewall portions 22 preferably extend about an entire circumference of the main body portion 14. The circumferentially spaced indentations 26 are preferably spaced substantially evenly about the entire circumference of the main body portion 14. Preferably, although not necessarily, there are an even number of the circumferentially spaced indentations 26 within each of the second sidewall portions 22.

In the illustrated embodiment, there are twelve of the indentations 26 defined within each of the second sidewall portions 22. Preferably, the number of indentations within each of the second sidewall portions 22 is within a range of about four to about fifty, and more preferably within a range of about eight to about twenty-four.

Referring again to FIGS. 1 and 2, it will be seen that each of the second sidewall portions 22 further includes a plurality of substantially vertical columns or beams 34, with each of the vertical columns or beams 34 being interposed between two adjacent ones of the circumferentially spaced indentations 26. The substantially vertical columns or beams 34 have the effect of providing additional column strength to the main body portion 14.

Figure 4:
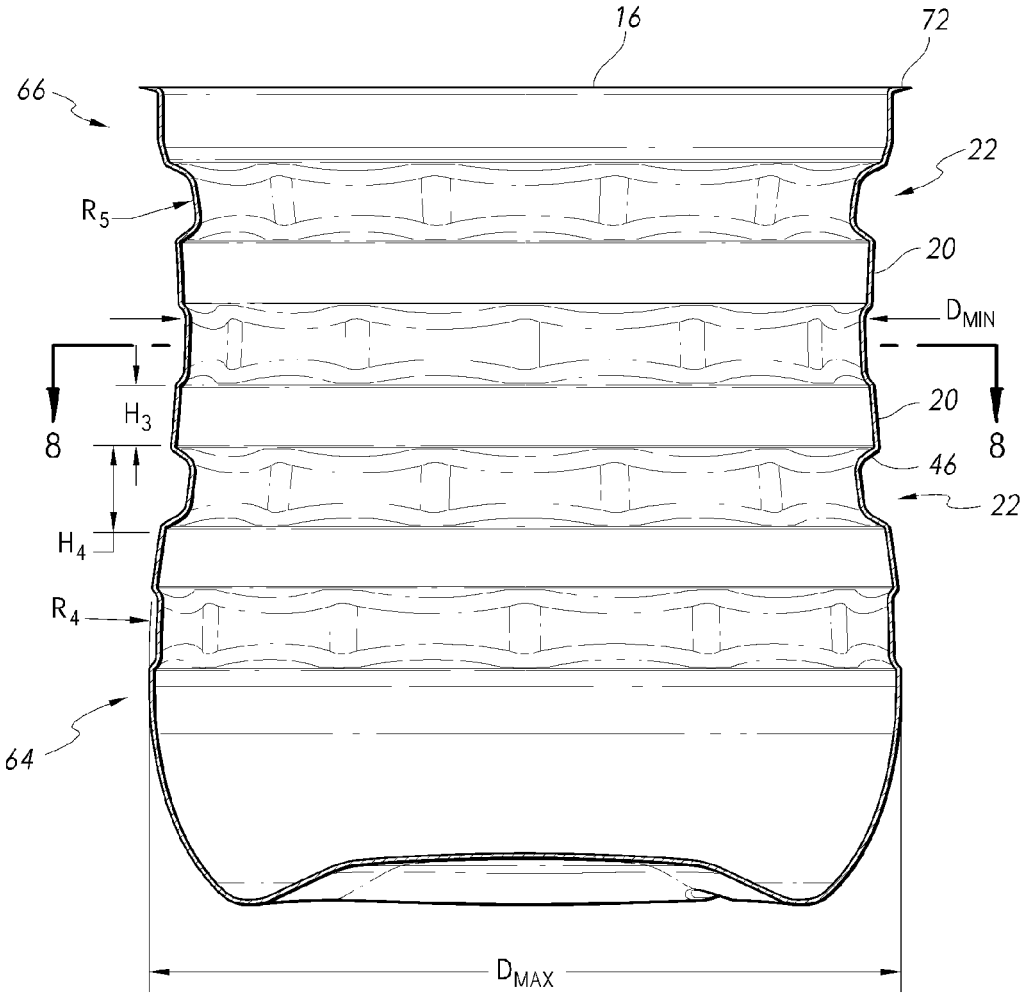
FIG. 4 is a longitudinal cross-sectional view of the retortable plastic container that is shown in FIG. 1.
Figure 8:
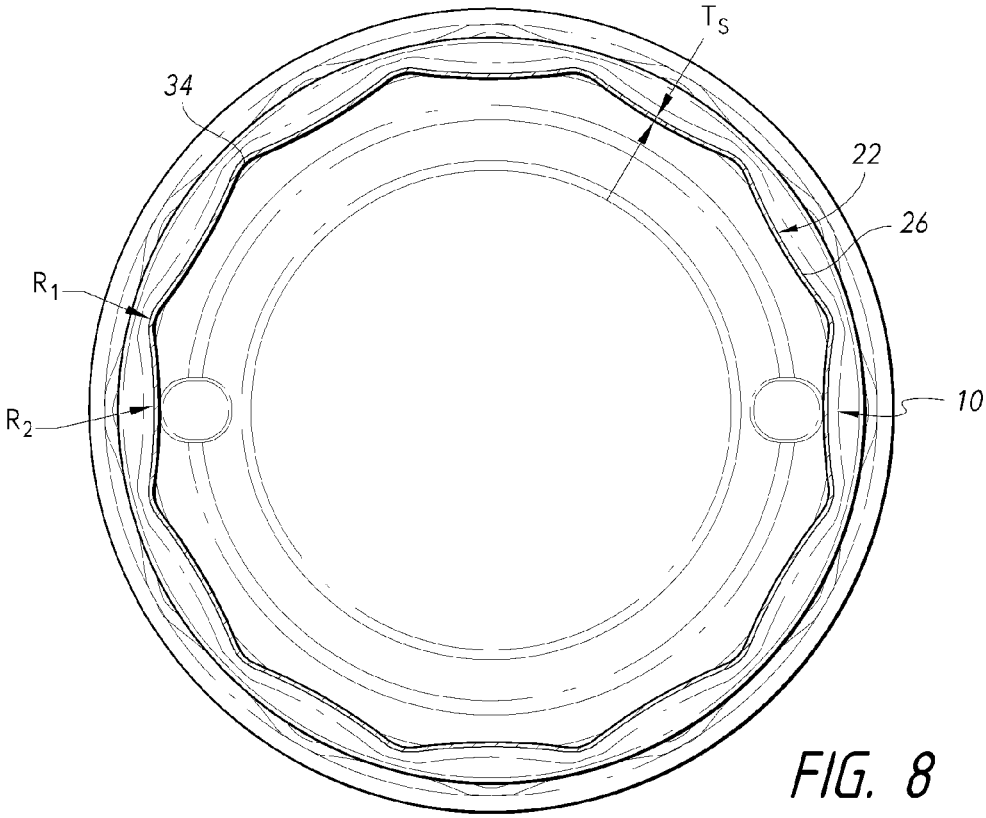
FIG. 8 is a diagrammatical representation of a horizontal cross-section taken along lines 8-8 in FIG. 4.

As FIG. 8 best shows, each of the substantially vertical columns 34 preferably has an outer surface that is convexly curved as viewed in transverse cross-section. The retortable plastic container 10 has a maximum diameter $D_{MAX}$ that is depicted in FIG. 4, which is preferably substantially within a range of about 40 mm to about 250 mm, more preferably within a range of about 45 mm to about 150 mm and most preferably within a range of about 55 mm to about 100 mm.

In the preferred embodiment, the convex curvature of the outer surface of the substantially vertical columns 34 is a substantially constant radius $R_1$, but alternatively a nonconstant radius could be used. Preferably, a ratio of the average radius $R_1$ of the outer surface of the substantially vertical columns 34 to the maximum diameter $D_{MAX}$ is substantially within a range of about 0.0195 to about 0.15, and more preferably substantially within a range about 0.03 to about 0.075.

As is also diagrammatically shown in FIG. 8, each of the indentations 26 preferably has an average concave radius of curvature $R_2$. In the preferred embodiment, the curvature is a substantially constant radius, but a nonconstant radius could alternatively be employed. Preferably, a ratio of the radius of curvature $R_2$ to the maximum outer diameter $D_{MAX}$ is substantially within a range of about 0.25 to about 1.5, and more preferably substantially within a range of about 0.5 to about 1.0.

FIG. 2 provides an enlarged view of one of the indentations 26 along with the surrounding structure. In the preferred embodiment, each of the indentations 26 has a horizontally oriented hourglass shape having a first side 40 that has a first vertical height, a second side 42 that has a second vertical height and a central portion 44 that has a minimum height $H_2$ that is preferably less than either of said first or second vertical heights. In the preferred embodiment, the first and second vertical heights are substantially equal to each other and are represented by the value $H_1$. A ratio $H_1/H_2$ is preferably substantially within a range of about 1.1 to about 2.0, and more preferably substantially within a range of about 1.25 to about 1.75.

In the preferred embodiment, a fillet 46 is defined between each of outer surfaces 24 of the adjacent first sidewall portions 20 and the floor 48 of each of the indentations 26. As FIG. 2 shows, each of the vertical columns 34 have a first end 50 that is joined to one of the fillets 46 and a second end 52 that is joined to another of the fillets 46. Each of the fillets 46 is concave as viewed in side elevation and has a radius $R_3$ that in the preferred embodiment is substantially constant. Preferably, a ratio of the radius $R_3$ to the maximum outer diameter $D_{MAX}$ of the retortable plastic container 10 is substantially within a range of about 0.01 to about 0.05 and more preferably substantially within a range of about 0.02 to about 0.04.

The second ends 52 of the vertical columns 34 on each side of the indentation 26 together with the first end 50 of the vertical column 34 that is centered with respect to the indentation 26 within the adjacent underlying second sidewall portion 22 together define a triangular shape that, in aggregate with the other triangular shapes that are likewise defined on the sidewall 18 creates an intermeshed complex force transmission structure that optimizes the column strength, the hoop strength and shear strength of the sidewall 18 and the main body portion 14.

Referring to FIGS. 5 and 6, the columns 34 when viewed in longitudinal cross-section are preferably slightly convex, having an average radius of curvature $R_6$.

Moreover, the complex curvature that is created by the fillets 46, the vertical columns 34 and the outer surfaces 24 of the adjacent first sidewall portions 20 provide structural reinforcement longitudinally, circumferentially and diagonally throughout the extent of the sidewall 18.

Figure 7:
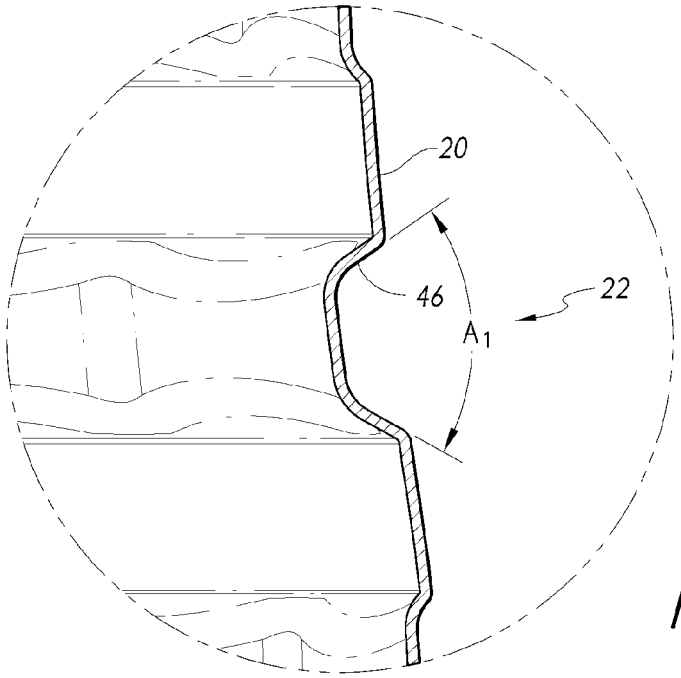
FIG. 7 is a cross-sectional view taken along lines 7-7 showing a portion of the sidewall in the container of FIG. 1.

As FIG. 7 shows, the second sidewall portions 22 define a wedge shape as viewed in longitudinal cross-section that defines an angle $A_1$ that is preferably substantially within a range of about 54° to about 74°, and more preferably substantially within a range of about 59° to about 69°.

As FIG. 4 shows, at least one of the first sidewall portions 20 has a first vertical height $H_3$, and at least one of the second sidewall portions 22 has a second vertical height $H_4$. In the preferred embodiment, all of the first sidewall portions 20 are of the same vertical height $H_3$, and all of the second sidewall portions 22 are of the same vertical height $H_4$. A ratio $H_3/H_4$ of the first vertical height to the second vertical height is preferably substantially within a range of about 0.20 to about 5.0, more preferably substantially within a range of about 0.50 to about 3.0 and most preferably within a range of about 0.7 to about 2.5.

In the preferred embodiment, adjacent second sidewall portions 22 are rotationally staggered with respect to each other so that the substantially vertical columns 34 within the respective adjacent second sidewall portions 22 are not aligned with each other. More preferably, the adjacent second sidewall portions 22 are staggered or rotationally displaced with respect to each other so that each of the vertical columns 34 is substantially centered with respect to one of the indentations 26 in the adjacent second sidewall portion.

The staggering of the vertical columns 34 maintains the high column strength that is imparted by the columns 34, while increasing the overall hoop and shear strengths of the main body portion 14.

The main body portion 14 includes a curved outer portion that defines a maximum outer width $D_{MAX}$ of the container 10 and a minimum outer width $D_{MIN}$, as is best shown in FIG. 4. In the preferred embodiment, the curved outer portion includes a convexly curved lower portion 64 having a first radius $R_4$ that defines the maximum outer width of the container 10 and a concavely curved upper portion 66 having a second radius $R_5$ that defines the minimum outer width $D_{MIN}$.

In an alternative embodiment, the structure of the sidewall 18 that is described above could be inverted so that the indentations 26 are protrusions and the vertical columns 34 are concave and extend inwardly rather than being convex.

In another alternative embodiment, the first and second sidewall portions 20, 22 could have a helical construction that would extend through the entire length of the sidewall 18 so that the sidewall 18 would have one continuous first sidewall portion 20 and one continuous second sidewall portion 22. For purposes of this document, such an embodiment would be considered to have a plurality of first sidewall portions and a plurality of second sidewall portions, since parts of both of the first and second sidewall portions would be longitudinally displaced from each other.

The sidewall 18 is preferably shaped to have a substantially constant thickness $T_S$, as is shown diagrammatically in FIG. 8, that is preferably substantially within a range of about 0.040 inch to about 0.065 inch for applications requiring heat sterilization, and more preferably substantially within a range of about 0.045 inch to about 0.055 inch. For other packaging applications in which heat sterilization is not anticipated, the thickness $T_S$ is preferably substantially within a range of about 0.015 inch to about 0.065 inch, and more preferably substantially within a range about 0.020 inch to about 0.055 inch.

Figure 9:
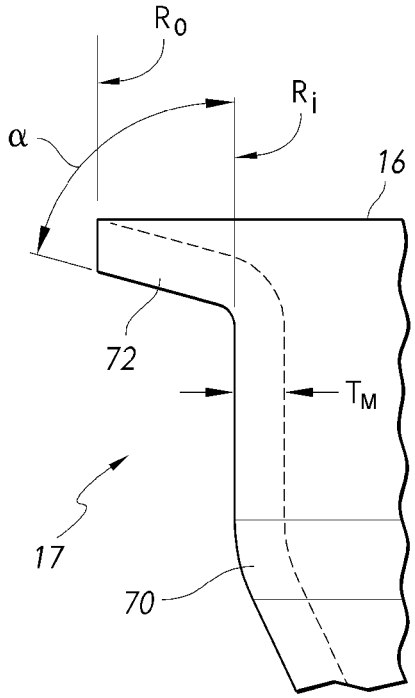
FIG. 9 is a fragmentary diagrammatical depiction of a portion of the retortable plastic container that is shown in FIG. 1.

Referring now to FIG. 9, it will be seen that the mounting portion 17 includes a substantially vertical sidewall portion 70 that is unitary with the sidewall 18 of the main body portion 14, and a mounting flange 72 that extends upwardly and outwardly at a first angle $\alpha$ from the substantially vertical sidewall portion 32 to define the rim 16. The substantially vertical sidewall portion 70 defines a first outer radius $R_i$, and the mounting flange 72 defines a second outer radius $R_O$ that is greater than the first outer radius $R_i$.

A difference between the second outer radius $R_O$ and the first outer radius $R_i$, which represents the width of the mounting flange 72 as viewed in longitudinal cross-section, is preferably substantially within a range of about 0.06 inch to about 0.12 inch. More preferably, the difference between the second outer radius and the first outer radius is substantially within a range of about 0.07 inch to about 0.11 inch.

A ratio $R_i/R_O$ is preferably substantially within a range of about 0.910 to about 0.985, more preferably substantially within a range of about 0.92 to about 0.975 and most preferably substantially within a range of about 0.93 to about 0.965.

The first angle $\alpha$ is preferably substantially within a range of about 55° to about 85°, and more preferably substantially within a range of about 65° to about 85°.

The upper mounting portion of the sidewall 18, including the substantially vertical sidewall portion 70 preferably has a thickness $T_M$ that is substantially within a range of about 0.01 inch to about 0.05 inch, and more preferably substantially within a range of about 0.02 inch to about 0.035 inch.

Figure 10:
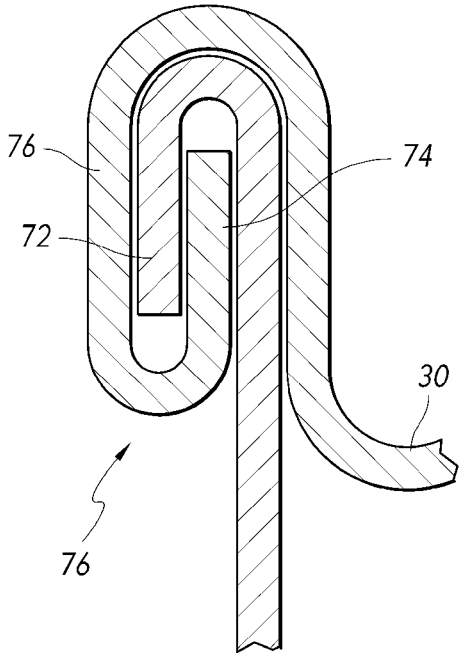
FIG. 10 is a fragmentary cross-sectional view depicting a portion of the retortable plastic container that is shown in FIG. 1.
Figure 11:
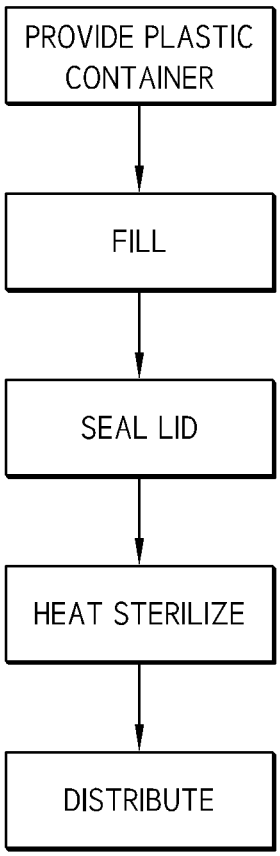
FIG. 11 is a flowchart depicting a method that is performed according to a preferred embodiment of the invention.

A method of providing a heat sterilized package product according to a preferred embodiment of the invention is depicted in FIG. 11 and would utilize the retortable plastic container 10 described above. The retortable plastic container 10 would be filled with a product, which could be a food or a beverage, and the lid 30 would be secured to the mounting flange 72 of the retortable plastic container 10 using a process such as the double-seaming process in order to seal the product within the closed container. A formed double seamed seal 76 is shown in FIG. 10, in which a distal edge 74 of the lid 30 is pinched between the folded mounting flange 72 about the periphery of the rim 16.

The lid 30 is preferably fabricated from a metallic material such as steel or aluminum. Alternatively, the lid 30 could be fabricated from a plastic material, or be of a composite design that includes both metallic material and plastic material. For example, the lid 30 could be fabricated from a plastic material that has a metallic insert with a tamper evident button that is designed to pop outwardly when the lid 30 is first removed from the container.

The closed container would then be subjected to a heat sterilization process such as a retort process in which the closed container is exposed to heated steam at temperatures of about 210° F. to about 260° F. for a predetermined period of time that is sufficient to kill any bacteria that may be within the closed container. The unique construction of the retortable plastic container 10 ensures that it will be able to survive such a heat sterilization process with a minimum of deformation and without being breached. The filled and closed container is then commercially distributed to consumers.

Figure 12:
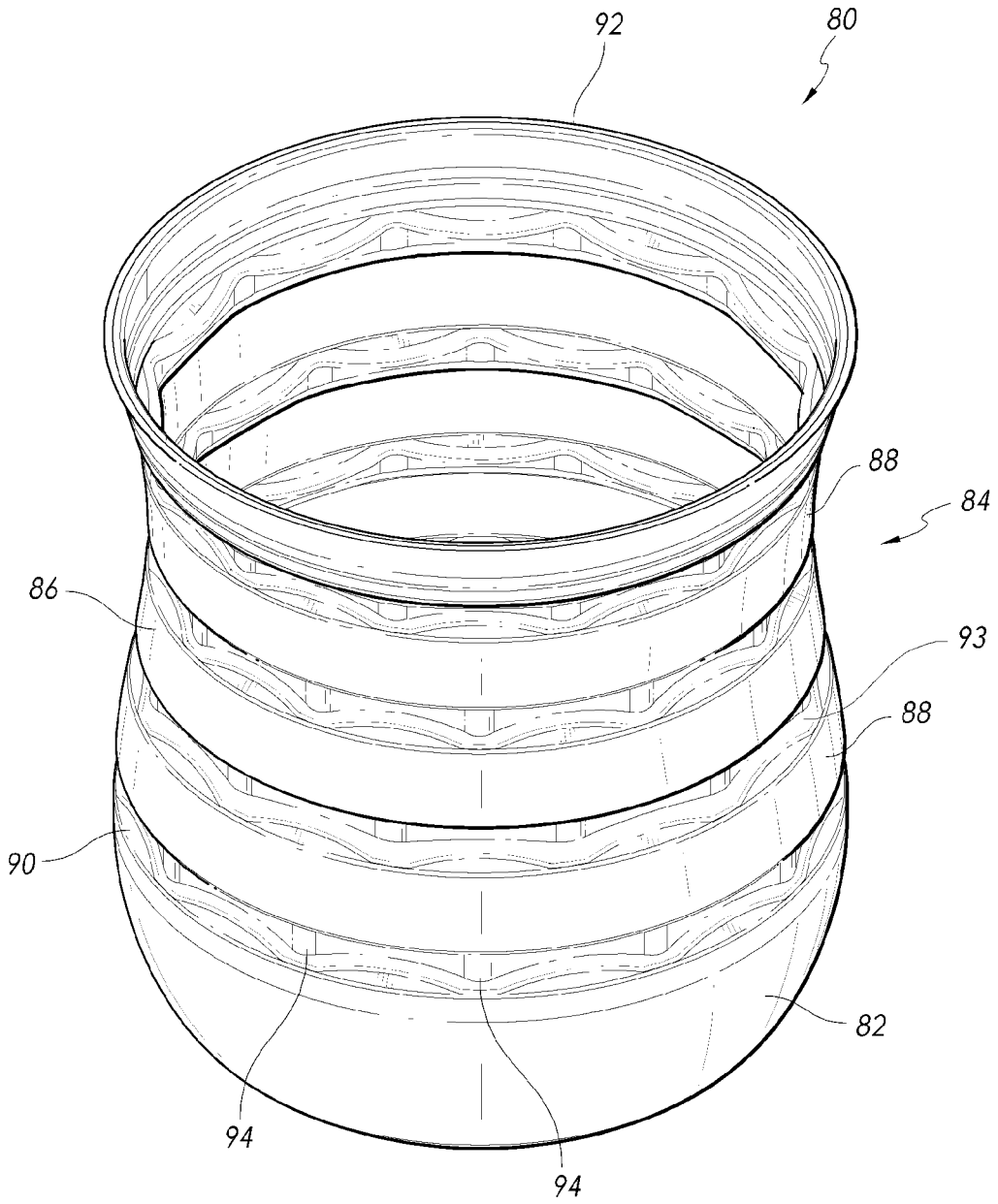
FIG. 12 is a perspective view of a retortable plastic container constructed according to an alternative embodiment of the invention.
Figure 13:
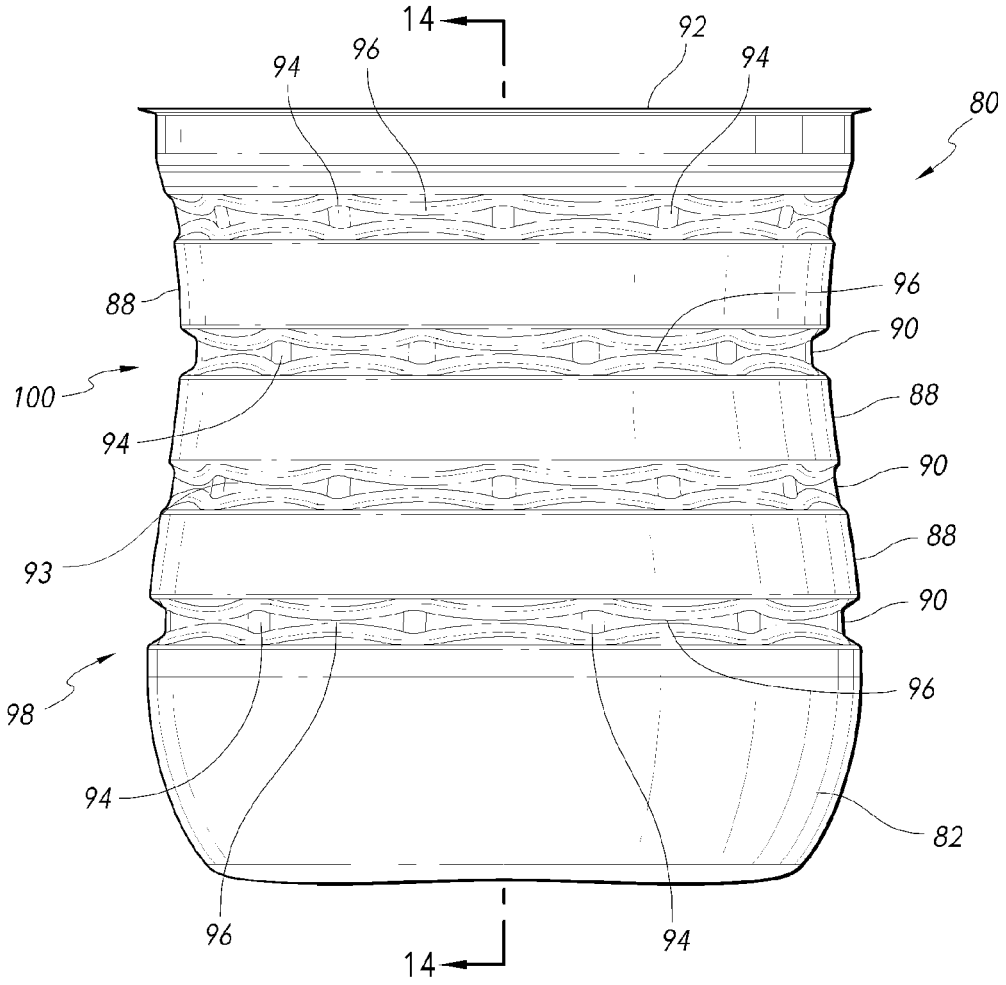
FIG. 13 is a front elevational view of the plastic container that is shown in FIG. 11.
Figure 14:
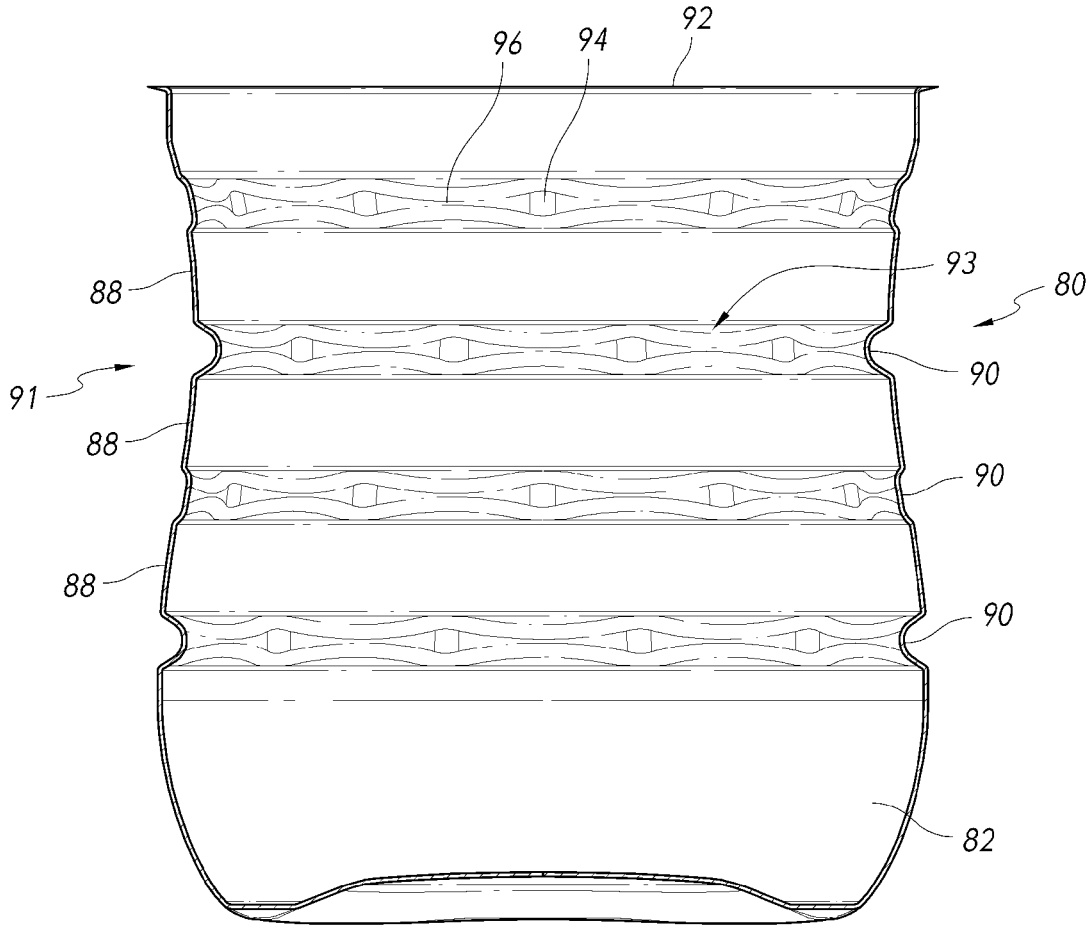
FIG. 14 is a cross-sectional view taken along lines 14-14 in FIG. 12.
Figure 15:
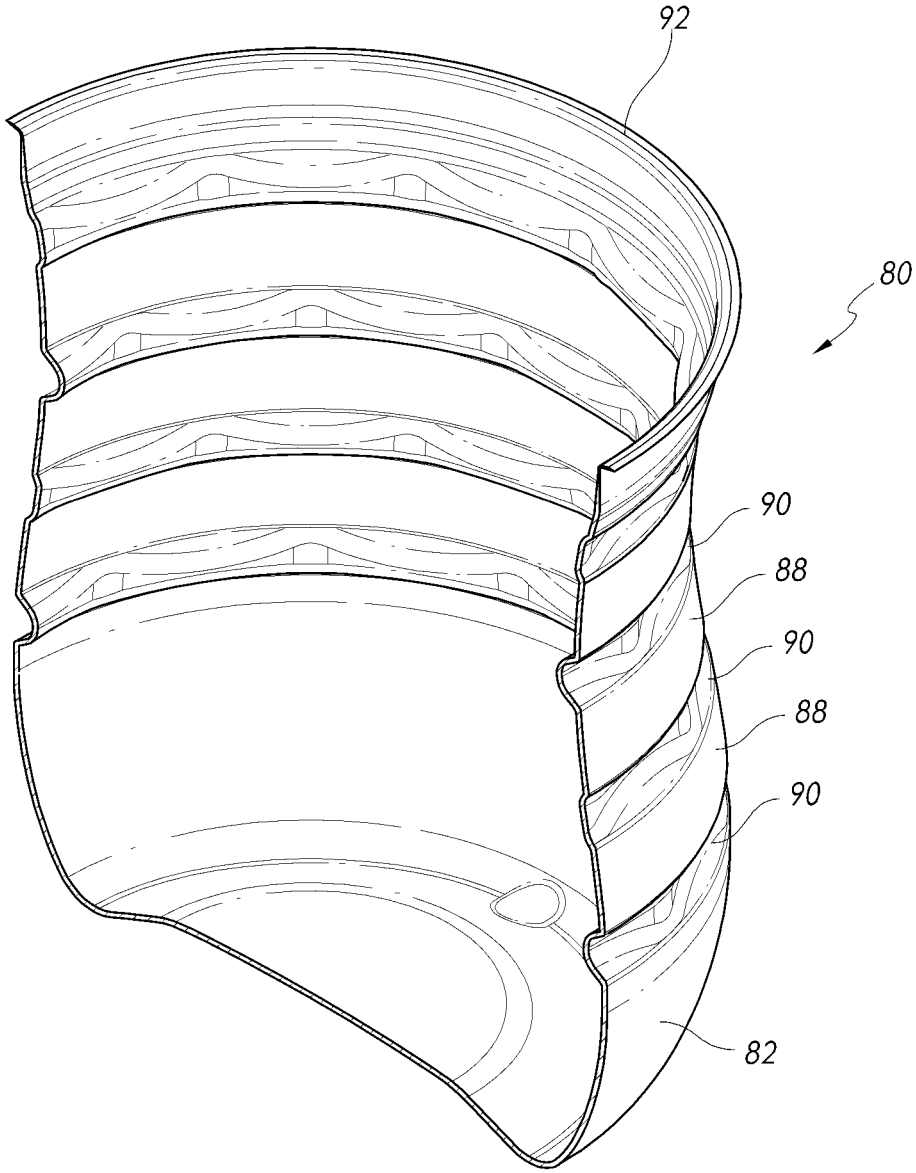
FIG. 15 is an isometric fragmentary view showing a portion of the plastic container that is depicted in FIG. 11.

Referring now to FIG. 12, a retortable plastic container 80 that is constructed according to an alternative embodiment of the invention includes a bottom portion 82 and a main body portion 84 that is defined by a sidewall 86. The entire plastic container 80 is preferably constructed from a plastic material that is suitable for heat sterilization applications, such as the materials discussed above with reference to the previously described embodiment.

The sidewall 86 preferably includes a plurality of circumferentially extending first side wall portions 88 and a plurality of circumferentially extending second side wall portions 90. Each of the second side wall portions 90 is interposed between two adjacent first side wall portions 88. Each of the second side wall portions 90 also preferably includes a groove 91 having reinforcement structure 93 provided therein for strengthening the second sidewall portion 90.

In the preferred embodiment, the reinforcement structure 93 is provided within all of the grooves 91 and is configured to limit vertical expansion and contraction, i.e. a "bellows effect," of the main body portion 88 in response to force that is applied to the sidewall 86. Such force may be the result of internal pressurization of the container 80 during the retort process, or top load force caused by stacking of containers during transport or retail display.

The shape and size of the groove 91 and reinforcement structure 93 is preferably as described in detail in U.S. Patent Application Publication US 2011/0226787, published Sep. 22, 2011, the entire disclosure of which is hereby incorporated by reference as if set forth fully herein.

The reinforcement structure 93 preferably includes a plurality of circumferentially spaced vertical columns 94, and a plurality of indentations 96, with each of the indentations being positioned between two adjacent vertical columns 94. Accordingly, the indentations 96 and the columns 94 alternate about the circumference of the second side wall portion 90.

Adjacent second side wall portions 90 are also preferably rotationally staggered with respect to each other so that the vertical columns on one second side wall portion are not aligned with the vertical columns of an adjacent second side wall portion.

The main body portion 84 is preferably shaped so as to be substantially symmetrical about a longitudinal axis.

The container 80 further includes a mounting flange 92 is adapted to be secured to a lid, preferably using the double seaming process that is described above with reference to the first embodiment of the invention.

The main body portion 84 is also preferably hourglass-shaped, having a convexly curved portion 98 and a concavely curved portion 100 positioned above the convexly curved portion 98.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A reinforced retortable plastic container, comprising:

a bottom portion; and a retortable main body portion connected to the bottom portion, the main body portion having a plastic sidewall fabricated from a plastic material suitable for heat sterilization applications, wherein the sidewall includes a plurality of circumferentially extending first sidewall portions having a similar shape in plan view and a plurality of circumferentially extending second sidewall portions, each of the second sidewall portions being interposed between two adjacent first sidewall portions, wherein each of the second sidewall portions includes a plurality of circumferentially spaced vertical columns, and wherein adjacent second sidewall portions are rotationally staggered with respect to each other so that the vertical columns on one second sidewall portion are not aligned with the vertical columns of an adjacent second sidewall portion, and further wherein the main body portion has a mounting portion adapted to have a lid mounted thereto, the mounting portion including a substantially vertical sidewall portion that is unitary with the sidewall of the main body portion, the substantially vertical sidewall portion having a first outer radius and a mounting flange extending upwardly and outwardly at a first angle from the substantially vertical sidewall portion, the mounting flange having a second outer radius that is greater than the first outer radius.

2. A retortable plastic container according to claim 1, wherein the main body portion is shaped so as to be substantially symmetrical about a longitudinal axis.

3. A retortable plastic container according to claim 1, wherein the sidewall is fabricated from a material comprising polypropylene.

4. A retortable plastic container according to claim 1, wherein the sidewall is shaped to define a curved outer surface when viewed in longitudinal cross-section.

5. A retortable plastic container according to claim 4, wherein the curved outer surface includes a convexly curved portion that defines the maximum outer width of the container.

6. A retortable plastic container according to claim 4, wherein the curved outer surface of the sidewall includes a concavely curved portion that defines a minimum outer width of the container.

7. A retortable plastic container according to claim 1, wherein the horizontally circumferentially extending first sidewall portions comprise a substantially flat outer surface.

8. A retortable plastic container according to claim 1, wherein each of the second sidewall portions further comprises a plurality of circumferentially spaced indentations.

9. A retortable plastic container according to claim 8, wherein the circumferentially spaced indentations are spaced substantially evenly about the entire circumference of the main body portion.

10. A retortable plastic container according to claim 8, wherein the indentations have a horizontally oriented hourglass shape.

11. A retortable plastic container according to claim 1, wherein each of the vertical columns has an outer surface that is convexly curved.

12. A retortable plastic container according to claim 1, wherein the main body portion has a sidewall thickness that is within a range of about 0.040 inch to about 0.065 inch.

13. A reinforced retortable plastic container, comprising:

a bottom portion; and a retortable main body portion having a plastic sidewall fabricated from a plastic material that is suitable for heat sterilization applications and that is connected to the bottom portion, the retortable main body portion having a reinforced sidewall area that comprises a plurality of first sidewall portions having a similar shape in plan view and a plurality of second sidewall portions that are respectively interposed between the first sidewall portions, wherein each of the second sidewall portions is shaped to define a plurality of circumferentially spaced structures that are selected from the group consisting of indentations and projections, wherein the main body portion has a mounting portion that is adapted to have a lid mounted thereto, the mounting portion including a substantially vertical sidewall portion that is unitary with the sidewall of the main body portion, the substantially vertical sidewall portion having a first outer radius and a mounting flange extending upwardly and outwardly at a first angle from the substantially vertical sidewall portion, the mounting flange having a second outer radius that is greater than the first outer radius.

14. A retortable plastic container according to claim 13, wherein the main body portion is shaped so as to be substantially symmetrical about a longitudinal axis.

15. A retortable plastic container according to claim 13, wherein the sidewall is fabricated from a material comprising polypropylene.

16. A retortable plastic container according to claim 13 wherein the sidewall is shaped to define a curved outer surface when viewed in longitudinal cross-section.

17. A retortable plastic container according to claim 16, wherein the curved outer surface includes a convexly curved portion that defines the maximum outer width of the container.

18. A retortable plastic container according to claim 16, wherein the curved outer surface of the sidewall includes a concavely curved portion that defines a minimum outer width of the container.

19. A retortable plastic container according to claim 13, wherein the main body portion has a sidewall thickness that is within a range of about 0.040 inch to about 0.065 inch.

* * * * *